US006808049B2

(12) United States Patent
Brand et al.

(10) Patent No.: US 6,808,049 B2
(45) Date of Patent: Oct. 26, 2004

(54) OPTIMAL PARKING OF FREE CARS IN ELEVATOR GROUP CONTROL

(75) Inventors: Matthew E. Brand, Newton, MA (US); Daniel N. Nikovski, Somerville, MA (US)

(73) Assignee: Mitsubishi Electric Research Laboratories, Inc., Cambridge, MA (US)

( * ) Notice: Subject to any disclaimer, the term of this patent is extended or adjusted under 35 U.S.C. 154(b) by 161 days.

(21) Appl. No.: 10/293,520

(22) Filed: Nov. 13, 2002

(65) Prior Publication Data

US 2004/0089503 A1 May 13, 2004

(51) Int. Cl.[7] ..... B66B 1/20

(52) U.S. Cl. ..... 187/383; 187/388; 187/385; 187/247

(58) Field of Search ..... 187/247, 248, 187/380–388; 701/56, 58

(56) References Cited

U.S. PATENT DOCUMENTS

| | | | | | |
|---|---|---|---|---|---|
| 3,851,735 | A | * | 12/1974 | Winkler et al. | 187/380 |
| 3,895,692 | A | * | 7/1975 | Yeasting | 187/382 |
| 4,147,235 | A | * | 4/1979 | Henry et al. | 187/387 |
| 4,511,017 | A | * | 4/1985 | MacDonald | 187/383 |
| 5,022,497 | A | * | 6/1991 | Thanagavelu | 187/382 |
| 5,503,249 | A | * | 4/1996 | Virtamo et al. | 187/382 |
| 5,637,841 | A | * | 6/1997 | Dugan et al. | 187/294 |
| 6,257,373 | B1 | * | 7/2001 | Hikita et al. | 187/392 |
| 6,401,874 | B2 | * | 6/2002 | Siikonen | 187/382 |
| 2001/0002636 | A1 | * | 6/2001 | Siikonen | 187/382 |

FOREIGN PATENT DOCUMENTS

| | | | | | |
|---|---|---|---|---|---|
| JP | 01317967 | A | * | 12/1989 | B66B/1/14 |
| JP | 2002037543 | A | * | 2/2002 | B66B/1/14 |

OTHER PUBLICATIONS

Pepyne et al. in "*Optimal dispatching control for elevator systems during uppeak traffic,*" IEEE transactions on control systems technology, 5(6):629–643, 1997.

* cited by examiner

*Primary Examiner*—Jonathan Salata
(74) *Attorney, Agent, or Firm*—Dirk Brinkman; Andrew J. Curtin

(57) ABSTRACT

A method controls the distribution of free cars in an elevator system. First, the number of free cars in the elevator system are counted whenever this number changes. At the same time, the arrival/destination rates of passengers at each of the floor is determined. The rates are used to identify up-peak and down-peak traffic patterns. The floors of the building are then assigned to zones. The number of floors in each zone is determined according to the arrival rates, and the free cars are then parked in the zones so that the expected waiting time of the next arriving passenger is minimized.

16 Claims, 4 Drawing Sheets

Algorithm 1 $x[1..C]$=STATIONARYPOLICY$(C, F, P[1..F])$

```
d := 2C
f := 1
for i := 1 to C do
    j := 2i − 1
    while P[f]d < j do
        f := f + 1
    end while
    x[i] := f
end for
```

*FIG. 2*

Algorithm 2 $L[1..N_c]$–DYNAMICPOLICY($N_c$, $\lambda$)

```
s[0][0].W := 0
s[1][0].W := Q(1, 0)
s[1][1].W := Q(1, 1)
U[1] = 0
L[1] = 1
for C := 2 to N_c do
    w_T := s[C − 1][U[C − 1]].W
    mincost := ∞
    for u := 0 to C do
        if u = C then
            W_u := 0
        else
            if u = U[C − 1] then
                W_u := w_T
            else
                w_0 := s[C − 1][u].W
                T := Time(C − 1, u, U[C − 1])
                W_u := w_0 − (w_0 − w_T)(1 − exp(−λT))/(λT)
            end if
        end if
        if u = 0 then
            W_l := 0
        else
            if u − 1 = U[C − 1] then
                W_l := w_T
            else
                w_0 := s[C − 1][u − 1].W
                T := Time(C − 1, u − 1, U[C − 1])
                W_l := w_0 − (w_0 − w_T)(1 − exp(−λT))/(λT)
            end if
        end if
        s[C][u].W := Q(C − u, u) + s[C][u].P_l W_l + s[C][u].P_u W_u
        if s[C][u].W < mincost then
            mincost := s[C][u].W
            U[C] := u
        end if
    end for
    L[C] := C − U[C]
end for
return L[1..N_c]
```

FIG. 4

OPTIMAL PARKING OF FREE CARS IN ELEVATOR GROUP CONTROL

FIELD OF THE INVENTION

The invention relates generally to elevator group control, and more particularly to optimizing group elevator scheduling and minimizing passenger waiting times.

BACKGROUND OF THE INVENTION

Group elevator scheduling is a well-known problem in industrial control and operations research with significant practical implications, see Bao et al., "*Elevator dispatchers for down-peak traffic,*" Technical Report, University of Massachusetts, Department of Electrical and Computer Engineering, Amherst, Mass., 1994. Given a hall call generated at one of the floors of a building with multiple elevator shafts, the basic objective of elevator group control is to decide which car to use to serve the hall call.

In some elevator systems, the controller assigns a car to the hall call as soon as the call is signaled, and immediately directs the passenger who signaled the hall call to the corresponding shaft by sounding a chime. While in other systems, the chime is sounded when the assigned car arrives at the floor of the hall call.

The traffic patterns of elevator passengers in buildings with multiple elevators varies considerably during certain periods of the day. In an office building, most of the passengers travel from the lobby to the upper floors in the morning, while at the end of the day, most passengers leave the upper floors and travel primarily to the lobby. In a high-rise residential building, the pattern is, of course, the reverse. These traffic patterns are known as up-peak and down-peak.

Up-peak and down-peak pose extraordinary demands on the scheduling processes for the elevator group, because the passenger arrival rate is high, and the traffic pattern is non-uniform. At the same time, these patterns can have a regular probabilistic structure, which could be exploited by car scheduling processes.

For example, free cars can be parked at floors to anticipate future hall calls in a manner that minimizes the usual optimization criterion in elevator group scheduling processes, i.e., the waiting time for future arriving passengers. The idea of moving free cars with the explicit purpose of favorably parking the cars with respect to future hall calls is well known in optimal group elevator scheduling. However, how to do this optimally remains an open question.

Zoning scheduling processes assign a free car to serve all hall calls originating from a fixed set of contiguous floors. Moving the free car to the middle of the zone in advance of hall calls is obviously advantageous to the scheduling process. Another possibility is to use the statistical properties of the traffic pattern in order to dispatch cars to the floors where the cars are most likely needed.

In the case of up-peak pattern, any free car is typically parked at the lobby for the next batch of arriving passengers. This insight has been used for pure up-peak pattern described by Pepyne et al. in "*Optimal dispatching control for elevator systems during up-peak traffic*," IEEE transactions on control systems technology, 5(6):629–643, 1997. However, pure up-peak traffic, where passengers arrive only at the lobby and only travel upwards, rarely occurs in real settings.

Several parking strategies for free cars are possible. The simplest strategy parks only a single car at a time, as soon as the car becomes free after servicing all previously assigned hall calls. Another strategy tries to maintain a predetermined number of free cars at a particular floor with high arrival intensity, e.g., the lobby in up-peak travel, and parks a free car at that floor only when the number of free cars there falls below a required minimum. However, it is known that this also is a suboptimal strategy.

It is desired to optimize the parking of free elevator cars in elevator group control for both up-peak and down-peak traffic patterns.

SUMMARY OF THE INVENTION

The invention provides for optimal parking of free cars in elevator group control so as to anticipate and quickly serve newly arrived passengers and minimize their waiting time. The invention provides a solution for both down-peak and up-peak traffic patterns. By matching the parking of free cars to the arrival rate of passengers, savings in waiting time of up to 80% can be achieved, particularly for down-peak traffic. For the much harder case of the up-peak traffic pattern, the invention models the elevator system as a Markov decision process (MDP) with relatively few aggregated states, and determines an optimal parking strategy by means of dynamic programming on the MDP model.

More particularly, a method controls the distribution of free cars in an elevator system. First, the number of free cars in the elevator system are counted whenever this number changes. At the same time, the arrival/destination rates of passengers at each of the floor is determined. The rates are used to identify up-peak and down-peak traffic patterns. The floors of the building are then assigned to zones. The number of floors in each zone is determined according to the arrival rates, and the free cars are then parked in the zones so that the expected waiting time of the next arriving passenger is minimized.

BRIEF DESCRIPTION OF THE DRAWINGS

FIG. 2 is a diagram of pseudo-code for a stationary parking policy;

FIG. 4 is a diagram of pseudo-code for a dynamic parking policy.

DETAILED DESCRIPTION OF THE PREFERRED EMBODIMENT

Introduction

Figure 1:
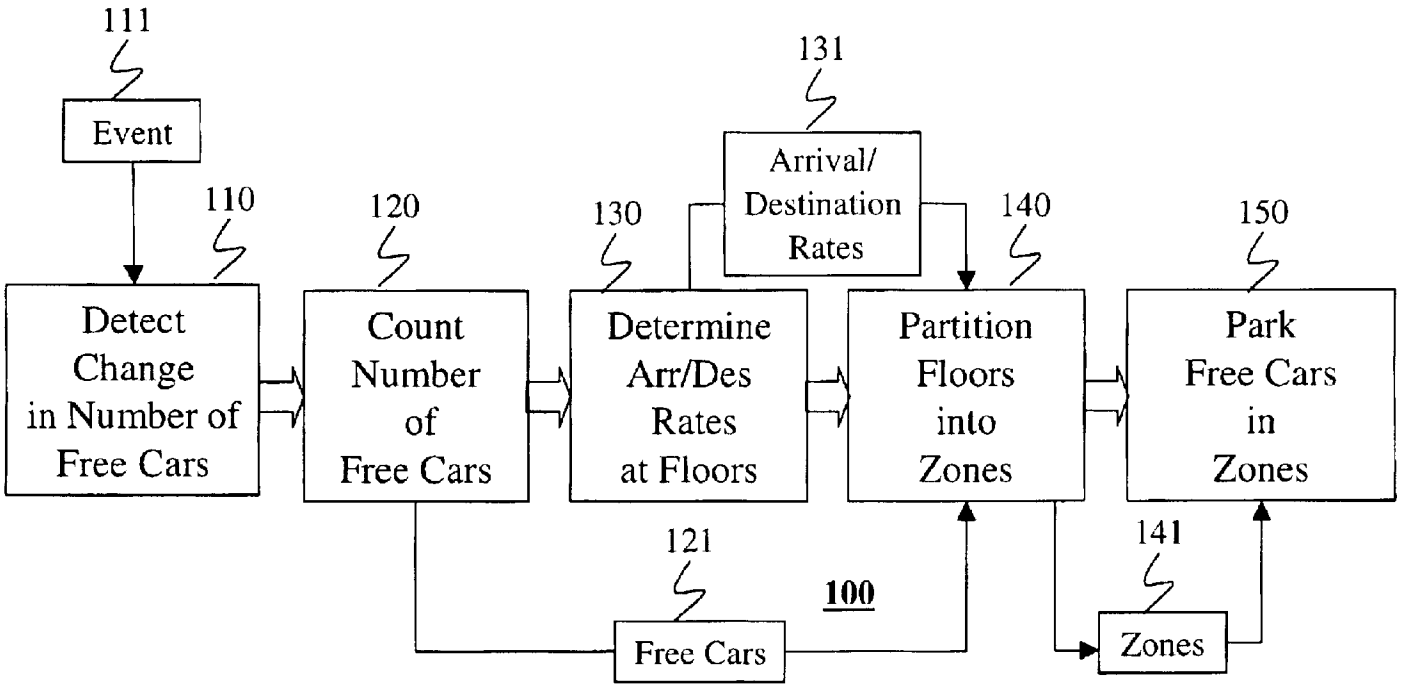
FIG. 1 is a flow diagram for parking free cars according to the invention.

As shown in FIG. 1, our invention provides a system and method 100 for optimally parking free cars in elevator group control so as to anticipate and serve newly arrived passengers and minimize their waiting time. By parking all current free cars, we mean that free cars that are already parked may be moved to a different floor, and if the free car does not move, it remains parked at its current floor. The invention parks 100 all cars that are currently free as soon as the number of free cars changes, due to one of the following two events 111.

For a first event 111, a car becomes free when all passengers assigned to that car have been serviced. This event increases the number of free cars by one. For a second event 111, a free car is assigned to service a new hall call. This event decreases the number of free cars by one.

According to our invention, the parking of free cars is initiated any time one of these two events is detected, even while parking is in progress for free cars that have not yet reached their assigned parking destination. In other words, the parking process 100 restarts as soon as the events 111 are detected.

Our invention determines on optimal strategy for where to park free cars given a particular peak traffic pattern, namely both the up-peak traffic pattern from the lobby to upper floors, and the down-peak traffic pattern from the upper floors to the lobby.

The invention handles arbitrary mixtures of up-peak, down-peak and inter-floor traffic. The case of up-peak traffic is considered as a special case because it affords extra optimizations and has economic significance as a performance factor for elevator control systems.

To make the problem tractable, we assumes that destination probabilities for the up-peak traffic pattern are uniform, i.e., passengers travel to each of the upper floors with equal probability. However, we do not make the assumption for the down-peak traffic that arrival probabilities at the various floors are uniform, i.e., a new hall call to the lobby is equally likely to originate at each of the upper floors because during the down-peak traffic pattern not all of the passengers originate uniformly at the upper floors, and this assumption is too restrictive.

We provide a full solution for the case of non-uniform arrival probabilities for the down-peak traffic pattern. Moreover, we do not restrict these two patterns to pure up-peak or down-peak traffic. While most of the passengers are traveling from the lobby to the upper floors, we still allow any amount of inter-floor traffic, as is the case in a practical elevator system.

Definitions, Parking Policies, and Their Execution

We model a building of F floors equipped with $N_C$ elevator cars. A hall call is signaled at a particular floor by a newly arrived passenger to be serviced. Typically, the hall call also signals the desired direction of travel, i.e., up or down. A car call is signaled by a passenger in an occupied car. A car call signals a particular floor to which the passenger desires to travel. At any particular moment in time, C of the $N_c$ cars are free, i.e., have no hall or car calls assigned to them so that $0 \leqq C \leqq N_c$.

When a hall call is signaled, a scheduling process assigns a car to the hall call, and that assignment is not changed. As a result, the number C of free cars decreases when the new hall call is assigned to a free car, or remains the same when the new hall call is assigned to an already occupied car. If the number of free cars C changes, i.e., an event 111 is detected, new parking locations for the remaining free cars are determined as described below, and the free cars are dispatched to these parking locations. Similarly, if a car completes servicing all assigned hall and car calls, then the number of free cars C increases, and new parking locations for the free cars are determined.

We assume that the parking locations always coincide with one of the floors, i.e., a car is never parked between floors. Under this assumption, a parking policy is a mapping between the number of free cars C and a vector x of C parking locations, where $x_i=1, \ldots, C$, such that $1 \leqq x_i \leqq F$. Thus, the number of possible mappings is $F^C$. Because some of these mapping policies are identical up to a symmetry, we use a canonical representation for a mapping such that $x_i \geqq x_j$ when i>j. Even after accounting for such symmetries, it is clear that the number of possible mappings is very large.

At the moment when a parking decision is made, a free car can be either already parked at a floor, or moving between floors due to the executing a previous parking decision. By $y_i=1, \ldots, C$, we denote the floors where each free car i is at that moment. If car i is not moving, then $y_i$ is simply the floor where the free car is parked. If the car i is moving, then $y_i$ is the first floor where it can stop in its current direction of travel. We assume that a car cannot reverse its direction between floors, even though such a possibility is likely to increase the responsiveness and efficiency of the parking method, if it were allowed.

After the locations $y=[y_1, y_2, \ldots, y_C]$ of the free cars are known, and the desired parking positions x have been determined, a parking plan has to be devised and executed by the elevator group control system. The objective of this plan is to move the free cars from their current positions y to the desired parking floors x as quickly as possible. Thus, the system has to decide which of the cars should go to each of the parking locations. Because there are O(C!) possible matches between the C parking positions and the C cars, finding the optimal plan is an extremely difficult problem, so far, not addressed in the prior art.

However, the invention supplies a heuristic that allows the parking decision to be executed efficiently in a short time. The invented heuristic preserves the vertical ordering of the cars.

This heuristic can be implemented by sorting the locations $y=[y_1, y_2, \ldots y_C]$ of the free moving cars in an ascending order, while simultaneously sorting the ordinal numbers k [1, 2, . . . C] of the cars in accordance with the sorting of $y_i$. Before sorting, the array of ordinal numbers is initialized so that $k_i=i$, for $i=1, \ldots, C$. For example, if initially y=[5, 3, 8, 1] and k=[1, 2, 3, 4] after sorting, then we obtain y=[1, 3, 5, 8] and k=[4, 2, 1, 3].

Because the policy x is already in canonical form, we can dispatch car $k_i$ to location $x_i$ for each $i=1, \ldots, C$. Continuing the above example, if the policy is x=[2, 4, 6, 8], then the system dispatches car 4 to the second floor, car 5 to the fourth floor, car 1 to the sixth floor, and car 3 to the eighth floor. This parking decision is very efficient because cars 1, 2, and 4 move only one floor, and car 3 remains stationary.

We now return to the problem of finding the optimal parking locations x given a particular peak traffic pattern, number of floor F, number of cars $N_C$, and speed and acceleration of the elevator cars.

Our general strategy in the two cases of interest, down-peak and up-peak traffic, is to first analyze how the passenger flow influences the final positions of the cars when they become free, then to identify inefficiencies resulting from uneven distribution of the free cars, and finally decide how the free cars should be parked so that the responsiveness of the system to new hall calls is improved.

As shown in FIG. 1, our method 100 executes from the beginning in response to detecting 110 an event 111. We count 120 the number of free cars in the elevator system at that time. We also determine 130 the current arrival/destination rates 131 of passengers at each floor. Any number of techniques for determining traffic-patterns, including using sensors such as cameras, can be used.

The rates are compared because the rates 131 are indicative of the traffic pattern. For example, a high arrival rate at the lobby indicates the up-peak traffic pattern, a high destination rate to the lobby indicates down-peak traffic. The current pattern determines which of the two parking policies described below to use to park the free cars.

On the basis of the arrival/destination rates 131 and the number of free cars 121, the F floors of the building are assigned 140 to a set of zones 141, the number of floors in each zone is determined to minimize expected the waiting time of future arriving (next) passengers according to the arrival rates 131. Typically, the floors in an assigned zone are physically adjacent. Lastly, we park or repark the C free cars 121 over the set of zones 141 so that the expected waiting time of the future arriving (next) passengers is minimized.

The specifics of the determining and parking steps are now described in greater detail: first for the down-peak pattern, and then for the up-peak traffic pattern.

Parking During Down-Peak Traffic Patterns

During the down-peak traffic pattern, the destination of most of the arriving passengers is the lobby. As a result, when a car becomes free, it is usually located at the lobby. If the free car remains at the lobby, then it is likely that it will not be at a floor where new calls are likely to originate, i.e., the upper floors. In order to amend this mismatch between where the free cars are and where they are needed the most, free cars are moved from the lobby and parked at the upper floors as soon as they become free.

There are two possible ways this can be done. The first way is to move only one free car at a time, as soon as it becomes free. The second way reparks all of the free cars, including the one that has just become free. Previously parked cars may or may not be moved. We provide a solution for the second way, because this approach results in more even distribution of cars with regard to the distribution of arriving passengers. In addition, our solution can also be modified for the first way, if moving all free cars all of the time is considered too expensive.

Because we try to minimize the expected waiting time of all arriving passengers, the optimal solution should minimize the expected waiting time of new hall calls for an infinitely long time interval, and should be based not only on the state of the free cars, but also on the state of occupied cars. Obtaining an optimal solution for this scenario requires an impractical amount of computation, because it is very uncertain when and where new hall calls will occur in the future, and what affect those future calls will have on the future locations of all cars.

In order to make the problem tractable for the case of down-peak traffic, we minimize the expected waiting time of only the very next future hall call (next passenger). However, this approach is not appropriate for up-peak traffic and is therefore extended below. Furthermore, we make the assumption that the first new hall call is served by one of the free cars, rather than one of the occupied cars. This assumption is justified for low and medium arrival rates, when the scheduling process typically serves a new hall call with a free car, rather than using an occupied car. This assumption allows us to ignore the state of the cars that are already occupied when deciding how to park the remaining free cars.

Finally, we assume that the new call occurs only after the desired parking location of the free cars has been attained. This assumption is also justified under low and medium arrival rates. In this case, the time to park free cars is negligible with respect to the time interval between passenger arrivals. Under these assumptions, we can define the expected waiting time of the next arriving passenger as a function of the state of free cars x as:

$$Q(x) = \sum_{f=1}^{F} p_f \min_i T(x_i, f),$$

where $p_f$ is the probability that the next passenger arrives at floor f, as determined from the arrival rates, $x_i$ is the location of the ith free elevator car, and $T(x_i,f)$ is the time it takes for the ith free car to serve the next arriving passenger at floor f, knowing fixed physical performance characteristics of the elevator cars, e.g., acceleration, maximum velocity, minimum stopping distance, etc. In general, the time $T(x_i,f)\neq 0$, even if the free car is parked at exactly the same floor where the hall call occurs. The waiting time would be zero only if the doors of the free car doors are already open.

In most cases, it is advantageous to keep the doors of free cars closed. There are two reasons for this. First, the free car can respond to calls not only at the floor where it is parked but also to calls at nearby floors. If the free car has to serve F floors, then the probability that the next hall call is signaled from the floor where the free is parked is 1/F. Second, the time $t_0$ to open doors is typically much faster than the time $t_c$ to close them, due to the need to provide safety for boarding passengers when closing the doors. If the doors are open, then the time $t_0$ to open the doors if the hall call is at the same floor as the free car is saved, but only with a low probability 1/F. However, if the hall call is not at the floor where it is parked, then the doors have to be closed, wasting time $t_c$ with a high probability (1−F)/F). In most cases, $t_0/F \ll t_c(F-1)F$, so we recognize that it is advantageous to keep the doors closed after parking the free car, and the time $T(f,f)\neq 0$.

We now consider the question whether it is advantageous to park free cars not only at exact floors, but also between pairs of adjacent floors, in order to further minimize Q(x). This is equivalent to allowing the parking positions $x_i$, 1, . . . , C to be continuous variables.

Returning to our definition of Q(x), and the selected optimization criterion, the optimal parking policy x* that minimizes Q(x) is $$x^* = \operatorname{argmin}_x Q(x) = \operatorname{argmin}_x \sum_{f=1}^{F} p_f \min_i T(x_i, f).$$

As noted, the number of all possible parking positions x is very large, and exhaustive computation of Q(x), would be time consuming. However, intuition suggests that the optimal policy parks the free cars as evenly as possible with respect to the distribution of future arriving (next) passengers. Let $p_f$ be the arrival probability for floor $$f, f = 1, \ldots, F, \sum_{f}^{F} = 1,$$

and $p_f=1$. An even distribution of cars with respect to this probability positions the C free cars so that their respective probabilities of serving the next hall call (future arriving passenger) is equal to (1/C).

One approximate way to achieve this is to assign 140 the F floors to a set of C zones, and parking 150 the free cars to the zones so that each zone is served by one of the C free cars. Given an array of cumulative arrival and destination probabilities $p_f$, f=1, . . . , F, such that $$P_f = \sum_{i=1}^{F} p_i,$$

this parking policy can be determined by a stationary parking policy procedure whose pseudo-code is shown in FIG. 2.

This solution is optimal with respect to the minimization criterion when the expected time to serve a next passenger is the same for each zone. In practice, however, this time is higher for larger zones, so a correction is necessary, in a direction of decreasing relatively larger zones so that these zones cover passenger arrivals with probability lower than 1/C. This correction is hard to obtain analytically, because it depends on the exact equations of motion of the elevator cars.

However, a relatively efficient process can be employed to find the truly optimal parking of free cars over the zones, if the floors are assigned 140 to C zones of equal probability by the stationary policy procedure described above. The parking policy determined by this process is denoted by $x^{(0)}$. Under the assumption that $x^{(0)}$ is in the vicinity of the true optimal parking policy x*, and furthermore, Q(x) is convex in this vicinity, we can take small steps from $x^{(0)}$ in a direction of a steepest decrease in $x^{(0)}$, thus reaching x* in a small number of steps. Because Q(x) is defined over a discrete number of parking policies, a greedy search strategy suffices.

We first set k:=0, and generate all immediate neighbors of a current policy $x^{(k)}$. These are the policies x' such that $|x_i-x_i^{(k)}|\leqq 1$, i=1, . . . , C, subject to the constraints $1\leqq x_i\leqq F$, i=1, . . . , C. Let $Q(x^{(k+1)})$ be a minimum among all Q(x'), and $x^{(k+1)}$ be the policy for which this minimum is attained. If $Q^{(k+1)}=Q^{(k)}$, then the optimal policy has been found, i.e., $x^*=x^{(k)}$; otherwise, k is increased by one and the process is repeated until convergence.

In order to illustrate the benefits of actively parking free cars so that the parked free cars match the distribution of future arriving passengers, we performed experiments in down-peak traffic, where 80% of the traffic originated at the upper floors with the destination being the lobby, 10% originated at the lobby with destination the upper floors, and the remaining 10% was traffic among the upper floors only.

The arrival rates of new passengers at the upper floors were uniform, i.e., $p_f=0.9/(F-1)$. Under this condition, the optimal parking policy for C free cars is the even assignment of floor to C zones, with free cars parked at the center of each zone. The parking positions were predetermined for each possible number of free cars being in the range $0\leqq C\leqq N_C$, and parking policies executed as described above.

Active parking according to the invention was compared to the case when no parking was performed and free cars were merely left at the floor where the last passenger was delivered. In both cases, we used a scheduling process based on dynamic programming, as described in U.S. patent application Ser. No. 10/161,304 "Method and System for Dynamic Programming of Elevators for Optimal Group Elevator Control," filed by Brand et al., on Jun. 3, 2002, incorporated herein in its entirety. The results show that actively parking the free cars so that they are equally distributed over the zones is very beneficial at low arrival rates, sometimes resulting in savings in waiting time of more than 80%.

Parking During Up-Peak Traffic Patterns

The parking solution based on matching the pattern of elevator parking locations to the pattern of passenger arrivals, while successful for down-peak traffic, is not sufficient for up-peak traffic. The reason for this is the very uneven distribution of arrival rates. A majority of passengers arrive at the lobby, and most of the waiting time is due to such passengers. Hence, it is of primary importance to reduce the waiting time at the lobby under this type of traffic pattern. However, parking free cars with respect to only such lobby passengers is not very efficient. If every free car is immediately sent to the lobby, then other floors are uncovered and the waiting time of passengers arriving at the upper floors starts to dominate the overall expected waiting time. For example, a passenger waiting for a minute there is equivalent to six passengers each waiting ten seconds in the lobby.

If there are C free cars, then some proportion of the free cars should be sent to the lobby, while the remaining free cars should be parked at the upper floors, again distributed evenly with respect to the arrival rates there. The question then becomes how to determine this distribution.

One solution always provide a constant number of cars at the lobby, e.g., two, and park the remaining free cars at the upper floors. However, this solution, while easy to implement, is not optimal, because the actual number of free cars required at the lobby depends on the arrival rate of new passengers and the number of floors. When the arrival rate at the lobby is relatively low, very few free cars need be parked at the lobby.

For example, if the arrival rate is only ten passengers per hour, i.e., the expected interval between arrivals is six minutes, then a single free car parked at the lobby is sufficient, because as soon as it departs from the lobby with a passenger on board, another free car can be sent to the lobby so that the expected waiting time for the next arriving passenger is not very long. For such low rates, all free cars, but one, can be parked at the upper floors in order to cover the building more densely, and thus reduce the expected waiting times of passengers arriving at the upper floors.

However, as the arrival rate increases, it becomes less and less likely that a new car will reach the lobby on time to serve newly arrived passengers. For example, consider the case where the arrival rate at the lobby is 1000 passengers per hour, i.e., the expected interval between arrivals at the lobby is 3.6 seconds. If only one free car is parked at the lobby and it departs to deliver an assigned passenger, then is highly unlikely that another free car will reach the lobby before the next passenger arrives, even if that free car is dispatched immediately. For such high arrival rates, it is better to park more than one car at the lobby.

Determining the optimal number of cars to park at the lobby also depends on the number of floors. If the number of floor is large, then a larger number of free cars should be parked at the upper floors, because these cars have to serve relatively larger zones with correspondingly longer response times. However, this decreases the number of free cars parked at the lobby, increasing the expected waiting time there.

Markov Decision Process for Up-Peak Traffic Patterns

In order to find the correct proportion between free cars parked at the lobby and free cars parked at the upper floors, we formulate the parking problem as a Markov decision process (MDP). The MDP includes a finite number of states $S_i$, i=1, . . . , $N_s$, a set of actions $A_i$, i=1, . . . , $N_a$, an immediate waiting time $w_{ijk}$ of the transition between each pair of states $S_i$ and $S_j$ under action $A_k$, a matrix $P_{ijk}$ of the probabilities of transition between states $S_i$ and $S_j$ under action $A_k$, and a distribution $\pi(S_i)$, which specifies the probability that the system starts in state $S_i$, see Bertsekas, "*Dynamic Programming and Optimal Control,*" Athena Scientific, Belmont, Mass., 2000. Volumes 1 and 2.

The optimization criterion that is used for down-peak traffic, i.e., the immediate expected waiting time Q(x) for only the next arriving passenger, is not adequate for the case of up-peak traffic. If only Q(x) is minimized, then the optimal number of free cars at the lobby always is one, because one car is sufficient to serve a new hall at the lobby. The remaining free cars are better utilized at the upper floors in order to minimize the expected waiting times of passenger arriving there.

However, as described above, this parking policy is not efficient for up-peak traffic with a high arrival rate, where the next arrival at the lobby uses the single free car parked there, leaving the lobby uncovered for future hall calls.

An appropriate optimization criterion for this traffic pattern minimizes the expected waiting time over a longer time interval, preferably infinitely long. In this case, it is more convenient to express the optimization criterion as the average over a sequence of N next passengers.

The true long-term expected waiting times of passengers, which is the exact criterion we optimize, is the limit of $\overline{W}_N$ as N becomes infinitely large, i.e., the time interval becomes infinitely long:

$$\lim_{N\to\infty} \overline{W}_N = \lim_{N\to\infty} \frac{1}{N} < \sum_{i=1}^{N} Q(s_i),$$

where $s_i$ is a state of the elevator system when the ith next passenger arrives, $Q(s_s)$ is the expected waiting time of passenger i. and the expectation < . . . > is taken with respect to the distribution of the next N arriving passengers.

Directly minimizing this optimization criterion is very hard, because the number of possible states of the system s is very large, and taking expectations with respect to all possible next passenger arrivals is computationally very expensive.

In order to formulate the optimization of this criterion in terms of a long time interval for an MDP with relatively few states, our strategy is to consider only a small number of all possible states of the system, and simplify the probabilistic structure of the evolution of these states as a result of selecting different parking policies.

The key to reducing the number of states in the MDP is the insight we have that a particular parking policy introduces a set of "attractor" states that the system converges to in the absence of passenger arrivals and free cars completing service. These states are exactly the parking positions specified by the parking policy. Suppose, for example, that a parking policy for a ten-floor building specifies that whenever four cars are free, two of them are parked at the lobby, the third one at the second floor, and the fourth one at the eighth floor. No matter what the initial location of the four cars is when the re-parking process starts, the final result is that the four cars assume their assigned parking positions and stay there until a new hall call is signaled. This decreases the number of free cars, until one of the occupied cars becomes free again.

It is these parking locations that we select to use as states of an aggregated MDP. However, because the system does not jump between such states instantly, but rather moves smoothly between them, we define the system to be in a particular state represented by a parking location not only when the system has assumed that state, but also when it is in the process of moving towards that state.

To further reduce the number of states, we assume that a parking position for the case of up-peak traffic is specified by the pair of numbers (L, U), where L is the number of cars parked at the lobby, and U is the number of cars parked at the upper floors. We further make the assumption that the cars are distributed evenly among the upper floors. In doing so, we implicitly assume that new arrivals at the upper floors are uniformly distributed. While this assumption is not always true, it is justified because a relatively small proportion of arrivals occur at the upper floors, and whatever non-uniformity exists among them is negligible with respect to the probability of passenger arrivals at the lobby.

Thus, after the pair (L, U) is given, and the number of floors F is known, the corresponding detailed parking location x can be generated by parking L cars at the lobby and distributing the remaining U cars among the upper floors of the building. As a consequence, we can define an immediate waiting time Q(L, U) of a state (L, U) as the corresponding immediate expected waiting time of the complete location x:

$$Q(L, U) \doteq Q(x).$$

Under our notation for parking states, the decision that has to be made, when C free cars are available, is how many of the free cars are sent to the lobby (L), and how many are parked at the upper floors (U=C−L). For example, if there are three free cars available, then the possible decisions are: (0, 3), (1, 2), (2, 1) and (3, 0). One very compact representation of such a policy is the dimensional vector of values $L_C$, C=1, . . . , N, whose $C^{th}$ element specifies how many cars are parked at the lobby when C cars are free.

In a building with $N_C$ cars, the number of possible policies is $N_C!$, which makes it impractical to compare all policies and select the optimal parking policy. Such a selection is further complicated by the stochastic nature of the arrival process. In order to meaningfully compare the statistical performance of two or more policies, the policies have to be executed over many possible scenarios, i.e., sequences of passenger arrivals, which is an added factor to the computational burden of a computation that already is exponential in complexity.

In order to evaluate these policies efficiently, we employ dynamic programming on the MDP model describing the probabilistic structure of the state evolution of the system. As noted above, the states in this model are aggregated "attractor" states corresponding to pairs of location ($L_C$, $U_C$) such that $L_C+U_C=C$, C=1, . . . , N. There are $(N_C+2)(N_C+1)/2$ such states for a building with $N_c$ cars.

Figure 3:
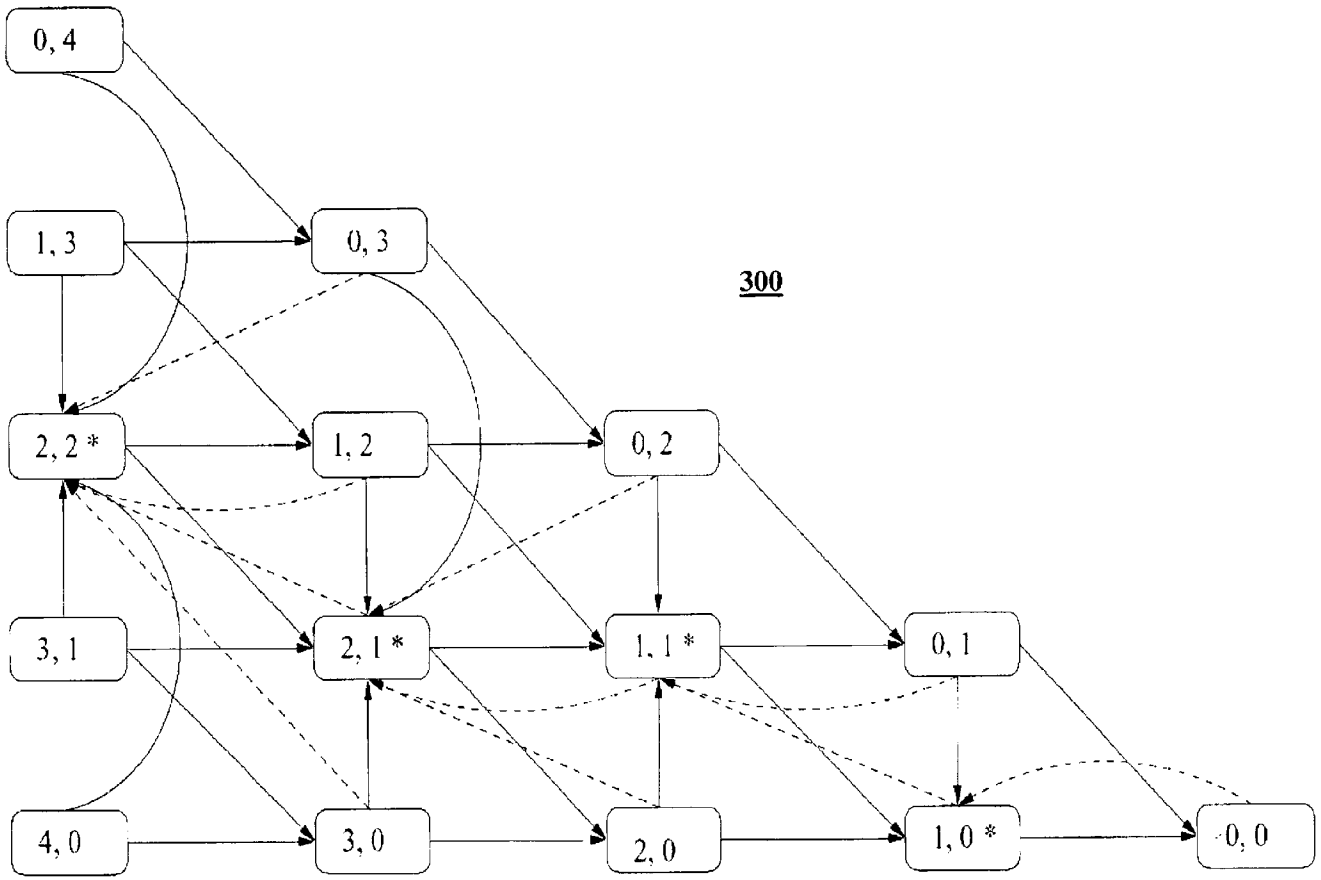
FIG. 3 is a diagram of states in a trellis used to model the method according to the invention.

As shown in FIG. 3, we organize the states in a regular structure 300 known as trellis in dynamic programming problems, and specify the probabilities of transitioning between such states as a function of a particular parking policy. FIG. 3 shows the organization of 15 states for a building with four cars, along with a transition structure for one particular policy, [1, 1, 2, 2].

Each state in the trellis is labeled by two numbers, the first of which is L, and the second U. The two numbers for states in the same column of the trellis add up to the same number of free cars C, and thus such states correspond to the possible parking decisions when there are C free cars. States in the same row have the same number of cars parked at the upper floors of the building, regardless of the number of free cars. The state (0, 0) is present in the trellis as well, even though there is no decision to be made in this case, because there are no free cars to park.

The states corresponding to the policy [1, 1, 2, 2] are denoted by asterisks (*) in FIG. 3. Under this policy, when one free car is available, it is parked at the lobby; when two cars are available, one is parked at the lobby, and the other free car in the zone including the upper floors of the building, e.g., the middle floor of the zone of upper floors. When three cars are available, two are parked at the lobby, and one at an upper floors. When four cars are available, two are parked at the lobby, and two are parked at the upper floors.

The selected parking policy determines the transitions that the MDP model follow under the influence of the up-peak passenger traffic, and the operation of the car scheduling process, which works independently of the parking policy, and can be arbitrary.

Solid lines depict transitions due to the arrival of new passengers. Such events reduce the number of free cars, and the transitions are from left to right. The dashed lines depict transitions corresponding to cars becoming free. Such events increase the number of free cars, and the transitions are from right to left. Finally, there are transitions between states within the same column. These exist because only one state within a column is stable. When the cars end up in any of the other states in that column, the elevator system starts moving the cars towards the parking location. We call such transient states sliding states.

The objective of the decision process is to select exactly one state per column to be the parking position for the respective number of free cars. The number of such selections is equal to the number of parking policies:

$$(N_C+2)(N_C+1)/2.$$

In order to avoid the combinatorial estimation of all such policies, the regular structure of the trellis 300 can be leveraged by a dynamic programming process to find the optimal parking policy, after certain simplifications of the model discussed below.

In theory, if all probabilities of the model were given, i.e., the transition probabilities for all policies, and not only for the one shown in FIG. 3, then it is possible to use policy iteration or value iteration in order to determine efficiently the policy that minimizes directly the optimization criterion stated above, i.e., the expected waiting times of all passengers over an infinitely long time interval:

$$\overline{W}_\infty = \lim_{N\to\infty} \frac{1}{N} < \sum_{i=1}^{N} Q(s_i) > .$$

In practice, finding the probabilities of cars becoming free, shown in FIG. 3 by dashed lines, is very hard. However, there is still a way to use only the left-to-right transitions for determining a suitable policy, if we amend slightly the criterion to be minimized. This is shown by solid lines in FIG. 3.

Instead of minimizing the expected waiting time over an infinitely long time interval, we can minimize the cumulative expected waiting times for the next C hall calls for all states (L, U) such that L+U=C. While this results in minimizing different criteria for the states in different columns of the trellis 300, this is not a problem, because the selection of a parking state is performed only among states within the same column, whose optimization criterion is the same. We define the optimization criterion for state so in column C as $$W_C(s_0) = < \sum_{i=1}^{C} Q(s_i) >,$$

where, as before, the expectation < . . . > is with respect to the next C arrivals, and $s_i$ is the state of the system when the $i^{th}$ call occurs.

The advantage of using this minimization criterion is that a recursive definition exists between $W_C(s)$ and $W_{C-1}(s')$, where $W_{C-1}(s')$ is the cumulative expected waiting times of the states s' in the next column in the trellis, i.e., the one to the right.

In order to see this dependency, consider what would happen if the system is in state s=(L, U), such that L+U=C, and a new passenger arrives. Because we are trying to determine whether s should be selected as the parking state when C cars are available, s is a stable state under this assumption and the free cars are at rest, awaiting the next hall at their parking positions.

The next hall call occurs at one of the floors according to the arrival rates. This call incurs an immediate waiting time of Q(L, U), as defined above, and moves the system to a state in the next column to the right, with one less free car.

Depending on where the hall call occurs, two scenarios can occur: either a parked free lobby car is dispatched to serve the call with probability $P_l$, or a free car parked at the upper floors is used with probability $P_u=1-P_l$. These two probabilities can be determined when the arrival rate 131 of passengers is known. These two scenarios give rise to two transitions out of s to the right column. In FIG. 3, the transition with probability $P_l$ leads to the state in the same row as s, and the transition with probability $P_u$ leads to the state one row below that of s. Using these two probabilities, we can decompose $W_C(s)$ as $$W_C(L,U)=Q(L,U)+P_lW'_{C-1}(L-1,U)+P_uW'_{c-1}(L,U-1),$$

where $W_{C-1}(l, u)$ is the additional waiting times of the next C−1 passenger arrivals when the first of them occurs when u free cars are parked at the lobby and l free cars are parked at the upper floors.

Note that, in general, $W'_{C-1}(l, u)\neq W_C(l, u)$ because $W_C(l, u)$ is the expected cumulative waiting time starting from ideal position for the C−1 parked free cars. $W'_{C-1}(l, u)$ is the expected cumulative waiting time of the C−1 free cars right after a car went into service, and the remaining C−1 cars are not parked yet.

After both transitions, the further waiting time $W'_{C-1}$ incurred by the system over the next C−1 calls depends on whether the transition was to the optimal state in the next column to the right, or to a sliding state that immediately transitions to the optimal state. The difference between these two cases arises from the fact that if the transition was to the optimal state, then the free cars do not move before the next call, because they are already parked optimally, and the time for answering the next call does not depend exactly on when it occurs.

On the contrary, if the transition is to the sliding state, then the expected waiting time for answering the next call depends strongly on exactly when the next call occurs. The waiting time ($w_0$) is longest when the next call occurs immediately after the event 111 is detected and the free cars are not yet parked optimally, and lowest ($w_T$) when the free cars have assumed their optimal parking position.

True immediate transitioning to the optimal state is only possible when a lobby car is used for the first call, and the optimal state for C−1 free cars is (L−1, U). For example, if we are computing the waiting time of state (2, 0), and the optimal state for one free car is (1, 0), then a passenger at the lobby uses the first lobby car and leaves the cars in the exact optimal state for one free car. This is not the case when a non-lobby free car is used.

Suppose, for example, that we are computing the waiting time of state (2, 2), and the optimal state for thee cars is (2, 1). While a passenger at one of the upper floors takes one of the free cars parked there, and leave two cars at the lobby and one at the upper floors. Just like in the optimal state for three cars, the remaining free car at the upper floors is not parked at the optimal position, i.e., the middle of the zone, but rather at one quarter or three quarters of the height of the zone, depending on which free car was used to service the call.

In order to make the problem tractable, we make the further simplification that the system transitions immediately to the optimal state in this case. The effect of this simplification is substantial because the time required to move to the optimal parking position is assumed to be quite small with respect to the inter-arrival interval at upper floors, where the arrival rate is low with respect to the arrival rate at the lobby.

The same simplification is also valid for the case when the new state after the transition is not optimal, but sliding. Using the same reasoning, we assume that the transition is instantaneous, and treat separately the consequences of that state not being optimal, but rather a sliding one.

We now return to the relationship between the additional waiting time $W_{C-1}(l, u)$ and of serving C−1 calls if the system is left with l+u free cars, which are not optimally parked yet, and the estimates $W_{C-1}(L, U)$ of the states in column C, each computed under the assumption that (L, U) is the optimal parking state. This relationship is straightforward if (l, u) is indeed the truly optimal parking state.

We assume that the arrivals of passengers are exponentially distributed over time with a mean of λ, i.e., the probability density on the time t until the next arrival is $P(t|\lambda)=\lambda e^{-\lambda}t$, $t \geqq 0$. The expected waiting time $W'_{C-1}(l, u)$, for the system to slide from state (l, u) towards the optimal state (L*, U*) with respect to the distribution of the next arrival is $$W'_{C-1}(l, u) = \int_0^\infty P(t \mid \lambda) w(t) dt = \int_0^\infty \lambda e^{-\lambda t} w(t) dt,$$

where w(t) is the waiting time for a passenger arriving at a time t before a free car is parked at the floor where the passenger arrives.

In order to compute this integral, we have to know the exact form of w(t) at all instances in time. The easiest approximation that can be done is to assume that w(t) decreases linearly over the time interval 0<t<T:

$$w(t) = w_T + \frac{T-t}{T}(w_0 - w_T), \quad 0 < t < T.$$

Here, $w_0$ is the waiting time should the next passenger arrive at the time the event 111 is detected, i.e., the start of the parking process, $w_T$ is the time all the free cars reach their parking positions in the zones, i.e., at the end of the parking process, and the time t is in between.

This is a reasonable working approximation, even though it is noted that for a short time right after the free cars start moving towards their parking locations the expected waiting timing actually exceeds $w_0$, because at that moment the moving cars have left their stationary position and can no longer immediately serve calls at the floors where they were parked previously.

Under the selected approximation of w(t) for the interval 0<t<T, the expected waiting time with respect to the time of the next arrival can be computed by splitting the integral above over two intervals:

$$W'_{C-1}(l, u) = \int_0^\infty \lambda e^{-\lambda t} w(t) dt = \int_0^T \lambda e^{-\lambda t} w(t) dt + \int_T^\infty \lambda e^{-\lambda t} w(t) dt = w_0(1 - e^{-\lambda t}) + \frac{(w_0 - w_T)(e^{-\lambda t} - 1)}{\lambda T} + w_0 e^{-\lambda t} = w_0 - \frac{(w_0 - w_T)(1 - e^{-\lambda t})}{\lambda T}.$$

The quantities $w_0$ and $W_T$ already incorporate the expectation over the location of the next arrival and the locations and times of the next C−2 arrivals, which turns the expression $$W_C(L,U)=Q(L,U)+P_l W'_{C-1}(L-1,U)+P_u W'_{C-1}(L,U-1),$$

along with the approximations for computing $W'_{C-1}(L-1, U)$ and $W'_{C-1}(L, U-1)$ above into a recursive formula for the estimation of the waiting times for all states in the trellis.

If reverse probabilities are ignored, then the state (0, 0) is terminal for the trellis, and its waiting time can be backed up by means of the recursive formula, which is essentially a Bellman back-up of the long-term waiting times of the states, see Bertsekas, "*Dynamic Programming and Optimal Control,*" Athena Scientific, Belmont, Mass., 2000.

The waiting time for state (0, 0) can be arbitrary, and for the sake of easier computation is set to zero.

As the process of backing-up proceeds from state (0, 0) towards columns with more and more free cars, from right to left in FIG. 3, the optimal parking location for each number of free cars can be determined by comparing the waiting times for all states in the same column of the trellis. The optimal state is $$(L^*_C, U^*_C)=\mathrm{argmin}_{(l,u)|l+u=C}[W_C(l, u)].$$

The optimal policy is determined as soon as the waiting times for all states in column C is backed up and before any back-ups in column C+1 are performed, because the back-ups for the states in column C+1 need the optimal state for column C in order to determine which of the states in that column is stable and which ones are sliding.

The whole process of backing up of the waiting times of parking states and parking policy determination is performed by the dynamic policy procedure shown in FIG. 4.

The dynamic policy procedure uses the function Time(C, $u_1$, $u_2$), which returns the time for the cars to move from the configuration corresponding to the state in row $u_1$, column C of the trellis to the configuration corresponding to the state in row $u_2$, column C of the trellis. The process starts computation from the second column of the trellis. If only one free car is available, then it is always optimal to leave the free car parked at the lobby. This is true if at least half of the passengers arrive at the lobby.

Effect of the Invention

The invention provides a method and system for optimally parking elevator cars under different patterns of passenger traffic. For the case of down-peak traffic, the cars are distributed equally over the floors of the building so as to minimize the expected waiting time of only the next passenger. This results in immediate savings in the expected waiting time for low and medium arrival rates. The cars are parked to match the arrival distribution of passengers at the various floors.

Minimizing the expected waiting time of only the first passenger is not sufficient for the case of up-peak traffic, where the main question is how many free cars should be kept at the lobby, given the number of floors and the overall arrival rate of passengers. The proposed solution to the problem of optimal parking for a group of elevators during up-peak traffic is based on the representation of the system as a Markov decision process with a small number of states corresponding to candidate parking locations, and a dynamic programming process for minimizing the expected waiting time of future passengers for longer, but still limited time intervals.

This solution captures the dependency between the arrival rate and the number of free cars to be parked at the lobby, yielding very good performance for low and medium rates.

Although the invention has been described by way of examples of preferred embodiments, it is to be understood that various other adaptations and modifications may be made within the spirit and scope of the invention. Therefore, it is the object of the appended claims to cover all such variations and modifications as come within the true spirit and scope of the invention.

We claim:

1. A method for controlling an elevator system in a building having a plurality of floors, comprising:

counting a number of free cars in the elevator system in response to detecting an event that changes the number of free cars;

determining arrival rates of passengers at each floor;

assigning the plurality of floors to a plurality of zones, the number of floors in each zone determined according to the arrival rates and to minimize an expected waiting time of a next arriving passenger; and parking the free cars in the plurality of zones so that the expected waiting time of the next arriving passenger is minimized.

2. The method of claim 1 wherein the counting, determining, assigning, and parking is performed as soon as the number of free cars changes even while the counting, determining, assigning and parking the free cars is in progress.

3. The method of claim 1 wherein the free cars are parked at middle floors of the plurality of zones.

4. The method of claim 1 wherein a particular zone consists of a floor having a highest arrival rate, and multiple free cars are parked in the particular zone.

5. The method of claim 1 further comprising:

determining destination rates of passengers at each floor;

comparing the arrival and destination rates to determine an up-peak traffic pattern and a down-peak traffic pattern.

6. The method of claim 1 wherein the expected waiting time Q(x) of the next arriving passenger is:

$$Q(x) = \sum_{f=1}^{F} p_f \min_i T(x_i, f),$$

where $p_f$ is a probability that the next arriving passenger arrives at floor f, as determined from the arrival rates, $x_i$ is a location of an ith free car, and $T(x_i,f)$ is a time required for the ith free car to serve the next arriving passenger.

7. The method of claim 6 wherein the expected waiting time Q(x) is minimized according to $$x^* = \operatorname{argmin}_x Q(x) = \operatorname{argmin}_x \sum_{f=1}^{F} p_f \min_\tau T(x_i, f).$$

8. The method of claim 5 wherein the number of zones is equal to the number of free cars for the up-peak traffic pattern.

9. The method of claim 5 wherein the traffic pattern is down-peak, and wherein the expected waiting time for N next arriving passengers is a limit of $\overline{W}_N$:

$$\lim_{N\to\infty} \overline{W}_N = \lim_{N\to\infty} \frac{1}{N} < \sum_{i=1}^{N} Q(s_i) >,$$

where N>1, $s_i$ is a state of the elevator system when an ith next passenger arrives, $Q(s_s)$ is the expected waiting time of the ith next arriving passenger, and an expectation $$< \sum_{i=1}^{N} Q(s_i) >$$

is taken with respect to a distribution of the N next arriving passengers on the plurality of floors.

10. The method of claim 9 wherein the number of free cars is C, and N=C.

11. The method of claim 10 wherein the expectation $$< \sum_{i=1}^{N} Q(s_i) >$$

is $$< \sum_{i=1}^{C} Q(s_i) >,$$

where the expectation $$< \sum_{i=1}^{N} Q(s_i) >$$

is with respect to the N next arriving passengers.

12. The method of claim 1 wherein the arrivals of the passengers are exponentially distributed over time t with a mean λ according to $$P(t|\lambda)=\lambda e^{-\lambda \cdot} t,\ t \geqq 0.$$

13. The method of claim 12 wherein the expected waiting time with respect to the distribution of the arriving passengers is $$\int_0^\infty P(t \mid \lambda) w(t)\, dt = \int_0^\infty \lambda e^{-\lambda t} w(t) dt$$

where w(t) is the waiting time for a particular passenger arriving at a time t before a free car is parked at the floor where the particular passenger arrives.

14. The method of claim 13 wherein w(t) decreases linearly from a time interval 0<t<T, and $$w(t) = w_T + \frac{T-t}{T}(w_0 - w_T),$$

$w_0$ is the waiting time if the next passenger arrives at a time when the event is detected, and $W_T$ is the waiting time if the next passenger arrives when the free cars are parked in the zones.

15. The method of claim 14 wherein the expected waiting for the interval $$0 < t < T \text{ is } =$$

$$\int_0^\infty \lambda e^{-\lambda t} w(t)\,dt = \int_0^T \lambda e^{-\lambda t} w(t)\,dt + \int_T^\infty \lambda e^{-\lambda t} w(t)\,dt = w_0(1 - e^{-\lambda t}) + \frac{(w_0 - w_T)(e^{-\lambda t} - 1)}{\lambda T} + w_0 e^{-\lambda t} = w_0 - \frac{(w_0 - w_T)(1 - e^{-\lambda t})}{\lambda T}.$$

16. A controller for an elevator system in a building having a plurality of floors, comprising:

means for counting a number of free cars in the elevator system in response to detecting an event that changes the number of free cars;

means for determining arrival rates of passengers at each floor;

means for assigning the plurality of floors to a plurality of zones, the number of floors in each zone determined according to the arrival rates and to minimize an expected waiting time of a next arriving passenger; and means for parking the free cars in the plurality of zones so that the expected waiting lime of the next arriving passenger is minimized.

* * * * *